US005746358A

United States Patent [19]

Crosby

[11] Patent Number: 5,746,358

[45] Date of Patent: May 5, 1998

[54] VENTED POURING SPOUT

[76] Inventor: Donald Crosby, 421 Light Foot Ct., Canton, Ga. 30115

[21] Appl. No.: 771,582

[22] Filed: Dec. 20, 1996

[51] Int. Cl.[6] ..... B67D 3/00

[52] U.S. Cl. ..... 222/479; 222/567

[58] Field of Search ..... 222/478, 479, 222/481.5, 538, 539, 568, 567

[56] References Cited

U.S. PATENT DOCUMENTS

| | | | |
|---|---|---|---|
| 1,849,950 | 3/1932 | Murdock | 222/478 X |
| 2,759,642 | 8/1956 | Rickard | 222/479 |
| 3,142,320 | 7/1964 | Olson | 222/537 X |
| 3,173,587 | 3/1965 | Stearns | 222/479 |
| 3,630,419 | 12/1971 | Pierce | 222/478 |
| 3,901,417 | 8/1975 | Schiemann | 222/479 |
| 3,966,099 | 6/1976 | Sanford, Jr. et al. | 222/478 |
| 4,588,111 | 5/1986 | Hestehave | 222/479 |
| 4,811,868 | 3/1989 | Mueller, Jr. et al. | 222/539 X |

FOREIGN PATENT DOCUMENTS

| | | | |
|---|---|---|---|
| 355795 | 2/1990 | European Pat. Off. | 222/478 |
| 15348 | 7/1902 | United Kingdom | 222/479 |
| 234993 | 6/1925 | United Kingdom | 222/481 |
| 775066 | 5/1957 | United Kingdom | 222/479 |

*Primary Examiner*—Kevin P. Shaver

[57] ABSTRACT

A spout (10) functioning to facilitate pouring of fluid (22) from a container (20). The spout (10) has a hollow base (12) which has a base bottom (12A) securely connected to a base stopper (12B) positioned at a top distal end, a base ring (12C) is securely affixed around the base bottom (12A) positioned a predetermined distance from the base stopper (12B) forming a base channel (12D) therebetween which is slightly larger than a width of a container lip (20B). The base ring angle (12CA) has a base ring (12C) positioned along a lower circumference end thereof. The improved spout (10 ) further has a hollow spout (16) sealably connected at a bottom distal end to the base stopper (12B). The spout (10) further has an air tube (14) securely positioned within the base (12) extending therethrough. The air tube (14) is securely and positioned within the spout (16) extending therethrough terminating at an upper distal end thereof. The air tube (14) extends a predetermined distance from the base (12). When an user tips the container (20), the fluid (22) enters the base (12) and the spout (16) pouring outwardly therefrom. Concurrently, air (24) enters an air intake (24A) positioned at the terminal upper end of the air tube (14) transcending therethrough exiting an air egress (24B) positioned at a terminal lower end thereof into the container (20) replacing the fluid (22) with air (24) therein at a similar rate as the fluid (22) is poured from the container (20).

7 Claims, 4 Drawing Sheets

VENTED POURING SPOUT

BACKGROUND OF THE INVENTION

1. Field of the Invention

The present invention relates to an improved spout. More particularly, the present invention relates to an improved spout having a base and a spout with an air tube inserted therethrough.

2. Description of the Prior Art

Spouts are well known in the art. They range in configuration from straight to curved to flexible. However, there exists a need for a spout which facilitates pouring of liquids from a container. Spouts are generally a hollow cylinder which does not allow air to enter the container when pouring liquids therefrom. As a result, the liquid is not poured in an even flow and tends to "glug." This situation may be hazardous when chemicals or other toxic substances are poured from a container. The "glug" intermittently allows a great deal of liquid to be expelled from the spout and splashes when it hits the pre-poured liquid.

Numerous innovations for spouts are present in the prior art that are adapted to be used. Even though these innovations may be suitable for the specific individual purposes to which they address, they would not be suitable for the purposes of the present invention as heretofore described.

SUMMARY OF THE INVENTION

The present invention relates to an improved spout. More particularly, the present invention relates to an improved spout having a base and a spout with an air tube inserted therethrough.

The types of problems encountered in the prior art are spouts do not permit an even flow of liquid from the container when poured therefrom In the prior art, unsucessful attempts to solve this problem were attempted namely: curved and flexible spouts. However, the problem was solved by the present invention because an air tube was inserted therethrough allowing air to continuously enter the container when the fluid is being poured therefrom.

Innovations within the prior art are rapidly being exploited in the field of safety equipment.

The present invention went contrary to the teaching of the art which describes and claims differing shaped spouts.

The present invention solved a long felt need for a spout to allow air to enter the container when fluid is being expelled therefrom.

Accordingly, it is an object of the present invention to provide an improved spout having a base and a spout with an air tube transcending therethrough.

More particularly, it is an object of the present invention to provide the base having a base bottom connected to a base stopper having a base ring with a base ring angle therebetween forming a base channel.

In keeping with these objects, and with others which will become apparent hereinafter, one feature of the present invention resides, briefly stated, in the base further having a base connector connected to an air tube.

When the air tube is designed in accordance with the present invention, it transcends through the base and the spout.

In accordance with another feature of the present invention, the spout has an attachment coller through which the spout is inserted in an attachment collar opening.

Another feature of the present invention is that the attachment collar female threaded member is engagable onto the container male threaded member of a container.

Yet another feature of the present invention is that the attachment coller further comprises an attachment coller lip circumferentially therearound and a plurality of attachment collar reinforcement thereon.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10—improved spout (10)
12—base (12)
12A—base bottom (12A)
12B—base stopper (12B)
12C—base ring (12C)
12D—base channel (12D)
12E—base connector (12E)
14—air tube (14)
16—spout (16)
18—attachment collar (18)
18A—attachment collar opening (18A)
18B—attachment collar female threaded member (18B)
18C—attachment collar lip (18C)
18D—attachment coller reinforcement (18D)
20—container (20)
20A—container male threaded member (20A)
20B—container lip (20B)
22—fluid (22)
24—air (24)
24A—air intake (24A)
24B—air egress (24B)

DESCRIPTION OF THE PREFERRED EMBODIMENT

Figure 1:
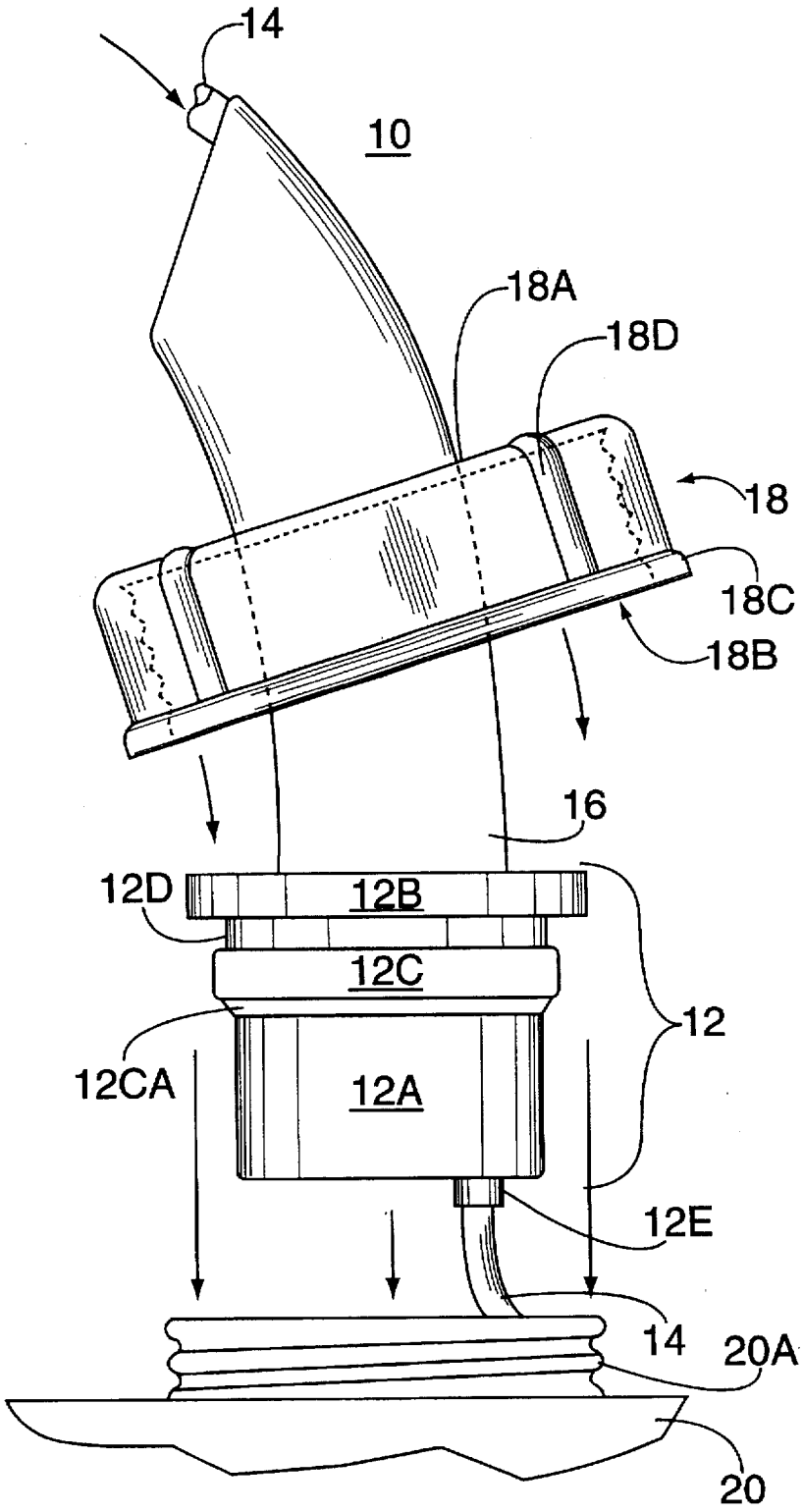
FIG. 1 is a side view of an improved spout being inserted into a container. The improved spout exhibits an attachment collar, positioned over a spout, threadably engagable onto a container male threaded member.

Firstly, referring to FIG. 1 which is a side view of an improved spout (10) being inserted into a container (20). The improved spout (10) exhibits an attachment collar (18), positioned over a spout (16), threadably engagable onto a container male threaded member (20A). The attachment collar (18) is only utilized when the container (20) comprises a container male threaded member (20A). The attachment collar (18) further comprises an attachment collar opening (18A) through which the spout (16) is positioned. The attachment collar (18) further comprises an attachment collar female threaded member (18B) which sealably engages the container male threaded member (20A). The attachment collar (18) further comprises an attachment collar lip (18C) positioned circumferentially around a lower end thereof. The attachment collar lip (18C) functions as a circular reinforcement. The attachment collar (18) further comprises a plurality of attachment collar reinforcements (18D) extending from the attachment collar lip (18C) to the attachment collar opening (18A). The plurality of attachment collar reinforcements (18D) function as vertical and horizontal reinforcements.

An improved spout (10) functions to facilitate pouring of fluid (22) from a container (20). The improved spout (10) comprises a hollow base (12) which comprises a base bottom (12A) securely connected to a base stopper (12B) positioned at a top distal end. A base ring (12C) is securely affixed around the base bottom (12A) positioned a predetermined distance from the base stopper (12B) forming a base channel (12D) therebetween which is slightly larger than a width of a container lip (20B). The base ring angle (12CA) comprises a base ring (12C) positioned along a lower circumference end thereof The improved spout (10) further comprises a hollow spout (16) is sealably connected at a bottom distal end to the base stopper (12B). The base (12) further comprises a base connector (12E) through which the air tube (14) passes and is attached thereto. The improved spout (10) is manufactured from a material selected from a group consisting of plastic, plastic composite, metal, metal alloy, epoxy, fiberglass, carbon-graphite, rubber and rubber composite.

Figure 2:
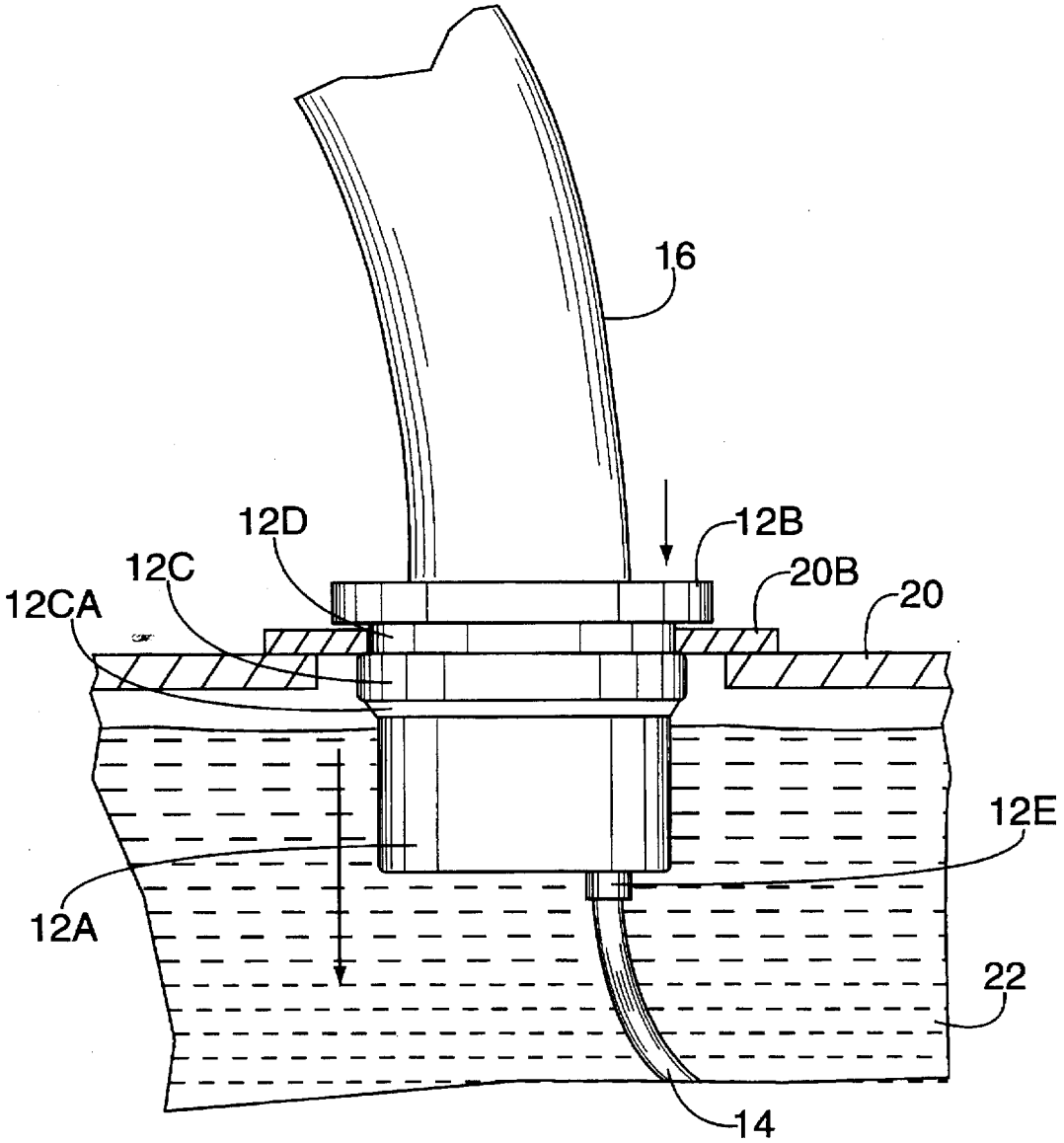
FIG. 2 is a partial cross-sectional side view of an improved spout inserted into a container. The improved spout exhibits a base channel engaged onto a container lip.

Referring to FIG. 2 which is a partial cross-sectional side view of an improved spout (10) inserted into a container (20). The improved spout (10) exhibits a base channel (12D) engaged onto a container lip (20B). The container lip (20B) is slightly larger than the base bottom (12A). The base ring angle (12CA) allows the base bottom (12A) to compress inwardly when pressure is applied thereto until the base channel (12D) engage the container lip (20B).

Figure 3:
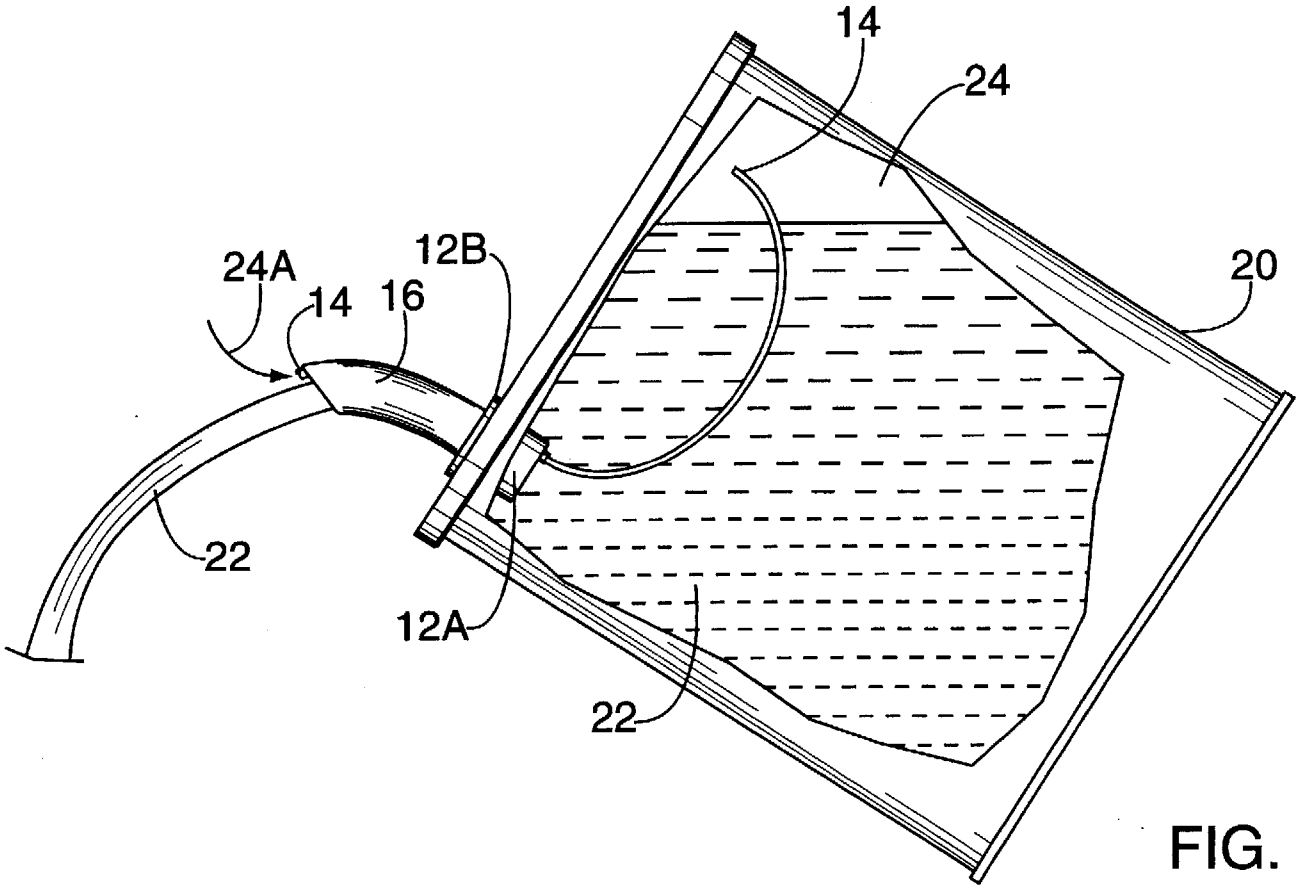
FIG. 3 is a partial cross-sectional side view of a container with an improved spout inserted therein and attached thereto exhibiting air intake at a front distal end of an air tube when fluid is commencing being poured from the spout.

Referring to FIG. 3 which is a partial cross-sectional side view of a container (20) with an improved spout (10) inserted therein and attached thereto exhibiting air intake (24A) at a front distal end of an air tube (14) when fluid is commencing being poured from the spout (16).

Figure 4:
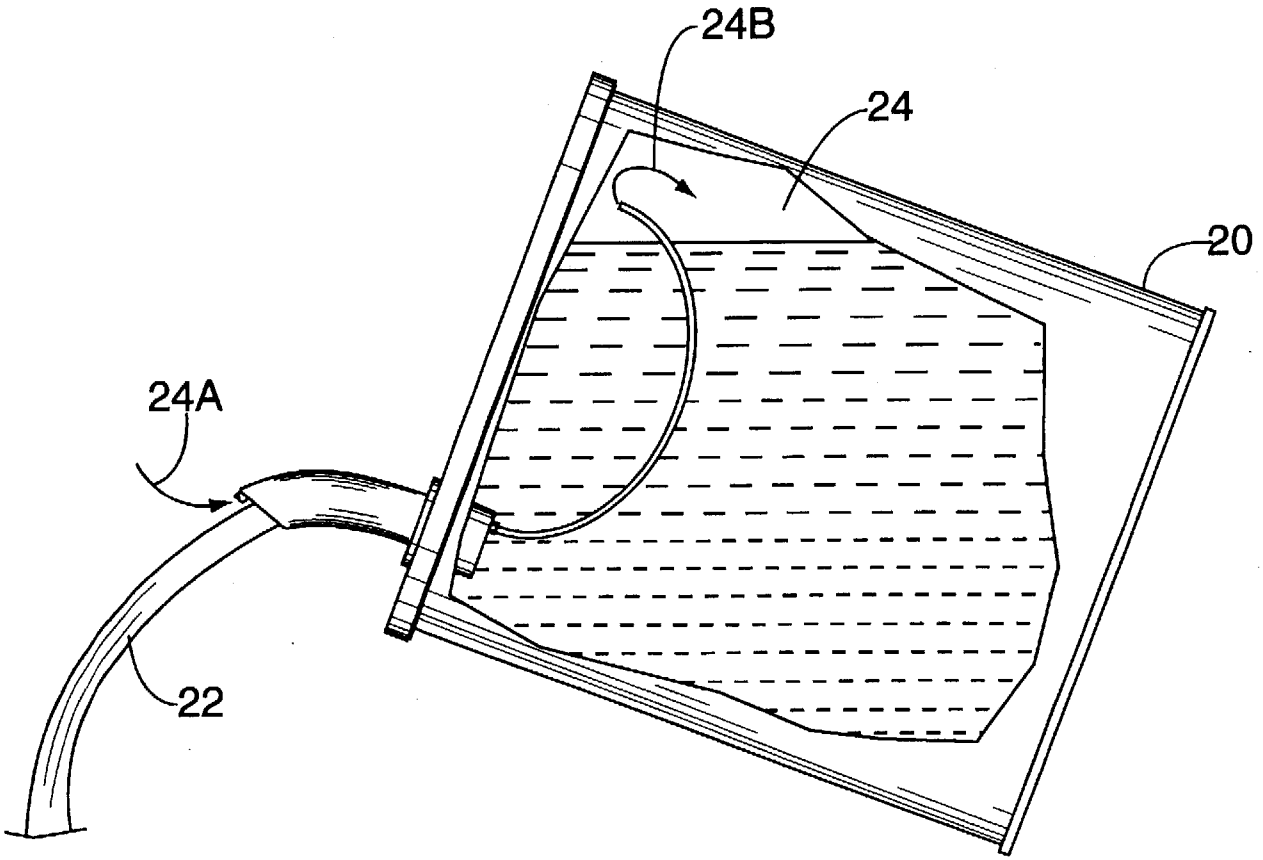
FIG. 4 is a partial cross-sectional side view of a container with an improved spout inserted therein and attached thereto exhibiting air intake and air egress at a front and rear distal ends of an air tube, respectively, when fluid is poured from the spout.

Lastly, referring to FIG. 4 which is a partial cross-sectional side view of a container (20) with an improved spout (10) inserted therein and attached thereto exhibiting air intake (24A) and air egress (24B) at a front and rear distal ends of an air tube (14), respectively, when fluid is poured from the spout (16). The improved spout (10) further comprises an air tube (14) securely positioned within the base (12) extending therethrough. The air tube (14) is securely and positioned within the spout (16) extending therethrough terminating at an upper distal end thereof. The air tube (14) extends a predetermined distance from the base (12). When an user tips the container (20), the fluid (22) enters the base (12) and the spout (16) pouring outwardly therefrom. Concurrently, air (24) enters an air intake (24A) positioned at the terminal upper end of the air tube (14) transcending therethrough exiting an air egress (24B) positioned at a terminal lower end thereof into the container (20) replacing the fluid (22) with air (24) therein at a similar rate as the fluid (22) is poured from the container (20).

It will be understood that each of the elements described above, or two or more together, may also find a useful application in other types of constructions differing from the type described above.

While the invention has been illustrated and described as embodied in an improved spout, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An improved spout (10) functioning to facilitate pouring of fluid (22) from a container (20), the improved spout (10) comprising:

A) a hollow base (12) which comprises a base bottom (12A) securely connected to a base stopper (12B) positioned at a top distal end, a base ring (12C) is securely affixed around the base bottom (12A) positioned a predetermined distance from the base stopper (12B) forming a base channel (12D) therebetween which is slightly larger than a width of a container lip (20B);

B) a base ring angle (12CA) is positioned along a lower circumference end of the base ring (12C);

C) a hollow spout (16) is sealably connected at a bottom distal end to the base stopper (12B);

an air tube (14) is securely and positioned within the base (12) extending therethrough, the air tube (14) is securely and positioned within the spout (16) extending therethrough terminating at an upper distal end thereof, the air tube (14) extends a predetermined distance from the base (12), when a user tips the container (20), the fluid (22) enters the base (12) and the spout (16) pouring outwardly therefrom, concurrently, air (24) enters an air intake (24A) positioned at a terminal upper end of the air tube (14) transcending therethrough exiting an air egress (24B) positioned at a terminal lower end thereof into the container (20) replacing the fluid (22) with air (24) therein at a similar rate as the fluid (22) is poured from the container (20).

2. The improved spout (10) as described in claim 1 further comprises an attachment collar (18) when the container (20) comprises a container male threaded member (20A).

3. The improved spout (10) as described in claim 2, wherein the attachment collar (18) further comprises an attachment collar opening (18A) through which the spout (16) is positioned, the attachment collar (18) further comprises an attachment collar female threaded member (18B) which sealably engages the container male threaded member (20A).

4. The improved spout (10) as described in claim 3, wherein the attachment collar (18) further comprises an attachment collar lip (18C) positioned circumferentially around a lower end thereof, the attachment collar lip (18C) functions as a circular reinforcement.

5. The improved spout (10) as described in claim 4, wherein the attachment collar (18) further comprises a plurality of attachment collar reinforcements (18D) extending from the attachment collar lip (18C) to the attachment collar opening (18A), the plurality of attachment collar reinforcements (18D) function as vertical and horizontal reinforcements.

6. The improved spout (10) as described in claim 1, wherein the base (12) further comprises a base connector (12E) through which the air tube (14) passes and is attached thereto.

7. The improved spout (10) as described in claim 1 is manufactured from a material selected from a group consisting of plastic, plastic composite, metal, metal alloy, epoxy, fiberglass, carbon-graphite, rubber and rubber composite.

* * * * *